United States Patent [19]

Goodnight

[11] Patent Number: 4,886,122

[45] Date of Patent: Dec. 12, 1989

[54] DRY CHEMICAL WAND

[76] Inventor: Fred B. Goodnight, Rte. 3, Box 751, Leeds, Ala. 35094

[21] Appl. No.: 222,792

[22] Filed: Jul. 22, 1988

[51] Int. Cl.[4] ..... A62C 13/24; A62C 35/50; B05B 1/26

[52] U.S. Cl. ..... 169/74; 169/70; 239/499; 239/500

[58] Field of Search ..... 169/74, 30, 71, 76, 169/77, 70, 89; 239/499, 500, 504, 588

[56] References Cited

U.S. PATENT DOCUMENTS

| | | | |
|---|---|---|---|
| 1,733,754 | 10/1929 | Reddemann | 239/500 |
| 1,745,297 | 1/1930 | Harry | 239/504 |
| 2,117,684 | 5/1938 | Schaaf | 169/30 |
| 2,545,951 | 3/1951 | Frese et al. | 239/499 X |
| 2,547,018 | 4/1951 | Kucher | 169/74 X |
| 2,566,324 | 9/1951 | Frese | 239/500 |
| 2,589,213 | 3/1952 | Allen | 169/74 |
| 2,651,372 | 9/1953 | Vanderwall | 169/74 |
| 2,681,707 | 6/1954 | Mapes | 169/74 X |
| 2,736,385 | 2/1956 | Siebens | 169/74 |
| 2,909,866 | 10/1959 | Blue | 239/504 |
| 2,967,570 | 1/1961 | Nurkiewicz | 169/70 |
| 2,978,187 | 4/1961 | Hesson | 239/499 |
| 2,985,383 | 5/1961 | Rasmusson et al. | 239/499 X |
| 3,172,607 | 3/1965 | Riuli et al. | 169/74 X |
| 3,204,698 | 9/1965 | Blackman | 169/74 |
| 3,313,353 | 4/1967 | Williamson et al. | 169/70 X |
| 3,527,412 | 9/1970 | West | 239/499 X |

FOREIGN PATENT DOCUMENTS

| | | | |
|---|---|---|---|
| 1340760 | 9/1987 | U.S.S.R. | 169/74 |

*Primary Examiner*—Joseph F. Peters, Jr.
*Assistant Examiner*—James M. Kannofsky
*Attorney, Agent, or Firm*—Jennings, Carter, Thompson & Veal

[57] ABSTRACT

A dispensing tool for use with dry chemical fire extinguishers utilizes an elongated wand bent near the discharge end through which the chemical is delivered. A dispersion baffle is affixed at the outlet of the wand to deflect the chemical radially. A horn surrounds the baffle and redirects the chemical in a dispersed stream onto a fire at a much lowered velocity such that the impact of the chemical on the burning material does not dislodge sparks or embers which lead to secondary fires.

3 Claims, 1 Drawing Sheet

DRY CHEMICAL WAND

FIELD OF THE INVENTION

The present invention relates to fire extinguishers and more particularly to dry chemical fire extinguishers. In greater particularity the present invention relates to dispersing apparatus for use with a dry chemical fire extinguisher to enhance the effect thereof.

BACKGROUND OF THE INVENTION

Dry chemical fire extinguishers are well known in the art and utilize a powdered or granular dry chemical which is discharged from a cylinder by the force of a pressurized gas such as carbon dioxide. Conventionally the discharge of the dry chemical is accomplished through a flexible tube having a terminal orifice which directs the dry chemical in a well-defined stream with sufficient velocity that the dry chemical may be effectively delivered at distances of twenty feet or more. Thus dry chemical extinguishers have a good standoff capability, however in some circumstances it is possible and even desirable to get much closer to the fire. At close range, the dry chemical particles being sprayed onto the fire at high velocity can actually spread the fire by breaking loose burning material and knocking it away from the point of impact of the dry chemical stream.

SUMMARY OF THE INVENTION

It is the object of the present invention to provide a discharge unit for a dry chemical fire extinguisher which can disperse a dry chemical stream and direct it onto a fire in a non-disruptive manner.

This object is advantageously accomplished through the use of an elongated tubular handle or wand through which the dry chemical flows. At the discharge end of the wand is a transverse baffle which disperses the dry chemical. The baffle is spaced from the end of the wand sufficiently to permit free passage of the chemical radially between the wand end and the baffle. Affixed to the end of the wand and surrounding the baffle is a shroud or housing which opens outwardly downstream of the baffle. The dry chemical stream dispersed by the baffle is thus reconstituted in a slower dispersed spray with an effective range of about two feet.

BRIEF DESCRIPTION OF THE DRAWINGS

An embodiment of my invention is depicted in the accompanying drawings which form a portion of this disclosure and wherein.

DESCRIPTION OF A PREFERRED EMBODIMENT

Figure 1:
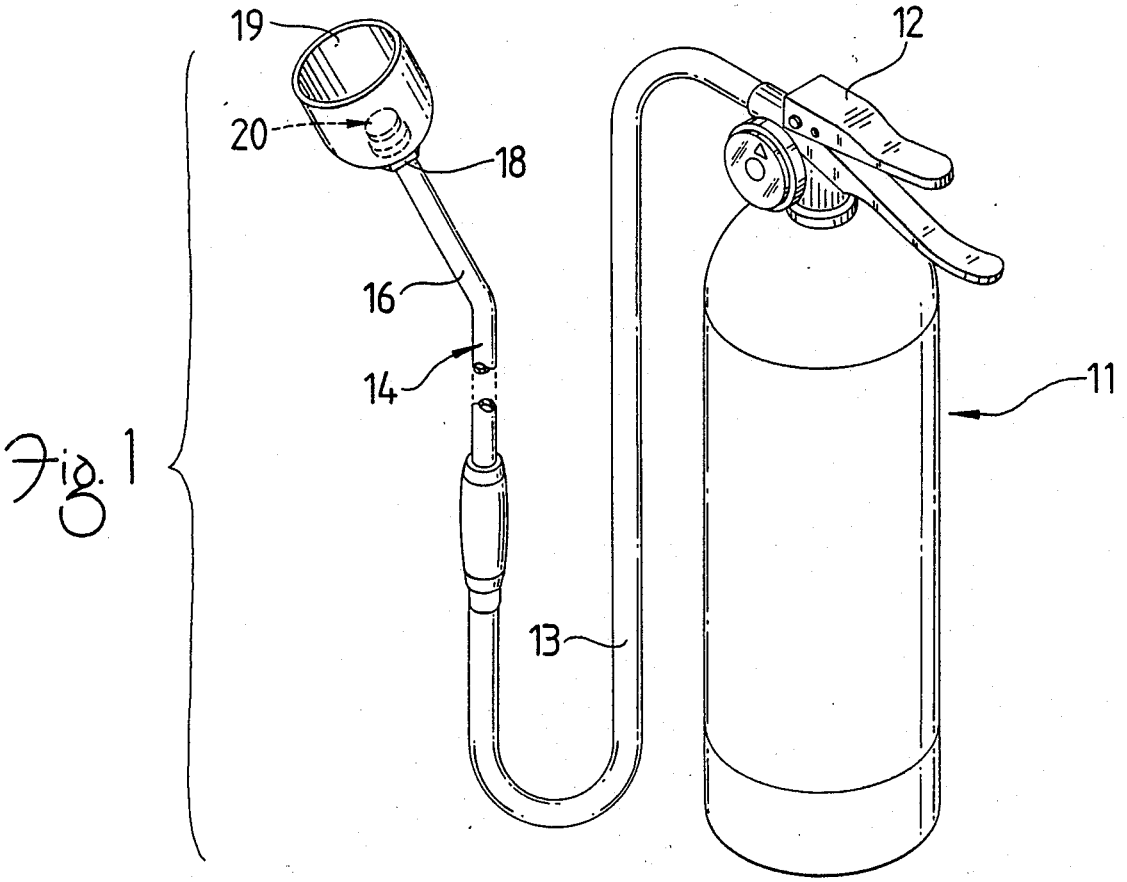
FIG. 1 is a perspective view of a fire extinguisher with my dispersal unit attached.
Figure 2:
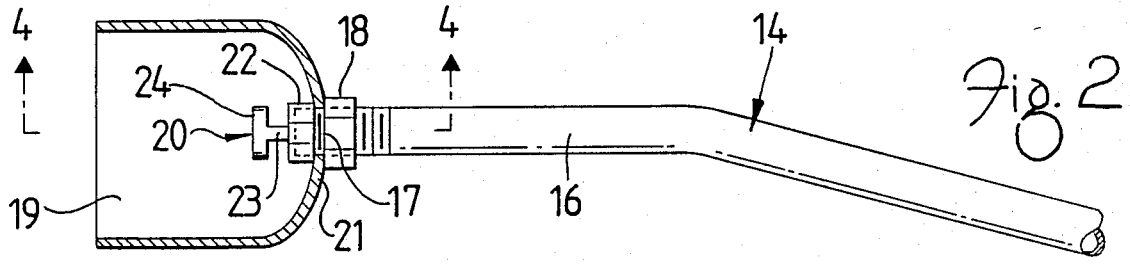
FIG. 2 is a partial sectional view of the wand and horn of my device.
Figure 3:
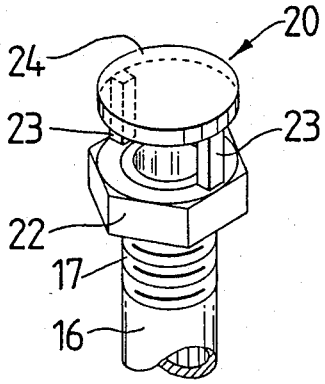
FIG. 3 is a detail perspective view of my baffle member.
Figure 4:
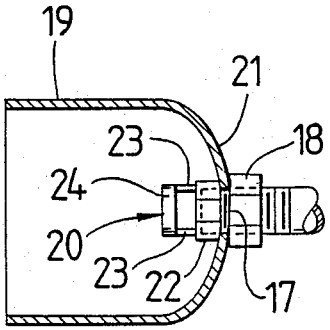
FIG. 4 is a sectional view taken along line 4—4 of FIG. 2.
Figure 5:
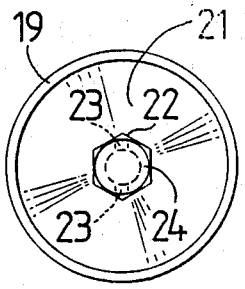
FIG. 5 is an end view of the horn and baffle member.

Referring to the Drawings for a more complete understanding of the invention, it will be appreciated that in FIG. 1, my apparatus is connected to a canister type dry chemical fire extinguisher 11. The fire extinguisher 11 has a manually operated release valve 12 connected to a length of flexible tubing 13. The fire extinguisher 11 may be any dry chemical extinguisher which forces a dry chemical under pressure in a stream through an output conduit and is depicted as a canister type for convenience only.

I utilize an elongated wand 14 connected at the end of the tubing 13 to provide extension beyond the firefighter's hand. The wand 14 may be of any convenient length but is preferably at least twenty-six inches in length. The wand 14 has a bend of about twenty to thirty degrees near the end 16 thereof opposite its connection to the tubing 13. The distal portion of end 16 is threaded as at 17 to receive a threaded retaining nut 18 thereabout. A horn 19 having a generally cylindrical shape and a rear wall 21 is symmetrically apertured to receive the end 16 therethrough such that the axis of the horn 19 is aligned with the axis of end 16.

A nozzle 20 is formed by a threaded member 22 which fits on the end 16 to secure the horn 19 in position. Integral with the threaded member 22 are a pair of spacers 23 which support a baffle 24 aligned perpendicular to the axis of the horn 19. The spacers 23 are separated and hold the baffle 24 such that large exit ports are formed between the threaded member 22 and the baffle 24.

In operation, the fire extinguisher 11 discharges a stream of dry chemical through the flexible tubing 13 and wand 19. The stream of dry chemical impacts the baffles 24 and is forced to exit the nozzle 20 radially through the large exit ports. The particulate dry chemical is dispersed into the larger volume of the horn 19 which redirects the dispersed stream in a generally axial direction. Of course impact with the baffle 24 and redirection in the horn 19 diminishes the energy in the moving particles and hence their velocity. Accordingly the dispersed stream of dry chemical has a range of about two to four feet. It can thus be seen that the bend in the wand 13 allows the firefighter to direct the extinguishing agent to the base of the flame and to visually observe the effectiveness of the agent, whereas a straight wand would discharge the agent in a manner that would tend to obscure the firefighter's vision of the effectiveness. With an appropriate wand, the firefighter may deliver the dry chemical from a distance of four to eight feet in a gentle manner that will not lead to further dispersal of sparks and/or embers, consequently, the effectiveness of the dry chemical fire extinguisher is greatly enhanced.

While I have shown my invention in one form, it will be obvious to those skilled in the art that it is not so limited but is susceptible of various changes and modifications without departing from the spirit thereof.

What I claim is:

1. A dispensing unit for use with a dry chemical firefighting agent stored in a reservoir under pressure comprising:

(a) a flexible hose operably connected to said reservoir to receive said fire fighting agent;

(b) an elongated tubular handle connected to said flexible hose for passing said firefighting agent therethrough in a concentrated stream, with said tubular handle being threaded along an end thereof distal said flexible hose and having threadedly mounted thereon a retaining nut, said tubular handle being bent proximal said threaded end;

(c) baffle means connected to said tubular handle distal said flexible hose and cooperatively positioned to deflect and dispense said concentrated stream of firefighting agent discharged axially of said tubular handle laterally thereof, and (d) means for directing said deflected and dispersed stream into a defined region including a horn attached to the end of said tubular handle and having a wall radially offset from said baffle and extending axially beyond said tubular handle with said horn having an central aperture through which said threaded end of said handle extends and said baffle means comprises a threaded member engagable with said threaded end and a planar member affixed thereto and offset therefrom by a plurality of spacers such that a plurality of radial openings are provided between said planar member and said threaded member, with said horn secured between said retaining nut and said threaded member.

2. A dispensing unit for use with a dry chemical firefighting agent stored in a reservoir under pressure comprising:

(a) a flexible hose operably connected to said reservoir to receive said firefighting agent;

(b) an elongated tubular handle connected to said flexible hose for passing said firefighting agent therethrough in a concentrated stream;

(c) baffle means connected to said tubular handle distal said flexible hose and cooperatively positioned to deflect and disperse said concentrated stream of firefighting agent discharged axially of said tubular handle laterally thereof, with said baffle means including a threaded member engagable with a threaded end of said tubular handle and a planar member affixed thereto and held in spacial relation thereto by a plurality of spacers such that a plurality of radial openings as provided between said planar member and said threaded member; and (d) means for directing said deflected and dispersed stream into a defined region.

3. A dispensing unit as defined in claim 2 wherein said directing means comprises a horn secured to said handle and extending outwardly and forwardly therefrom about said baffle means.

* * * * *